US006200231B1

(12) United States Patent
Moriyama et al.

(10) Patent No.: US 6,200,231 B1
(45) **Date of Patent: *Mar. 13, 2001**

(54) HOLLOW SOLID GOLF BALL

(75) Inventors: Keiji Moriyama, Shirakawa; Hiroyuki Tsujinaka, deceased, late of Kobe, by Minoru Tsujinaka and Kinuko Tsujinaka, legal representatives; Kazuo Hochi, Amagasaki; Masaya Tsunoda, Akashi; Akihiro Nakahara, Ibaraki; Kiyoto Maruoka, Kobe; Kazuhisa Fushihara, Kakogawa, all of (JP)

(73) Assignee: Sumitomo Rubber Industries, Ltd., Hyogo-ken (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 08/983,565

(22) PCT Filed: May 22, 1997

(86) PCT No.: PCT/JP97/01718

§ 371 Date: Mar. 23, 1998

§ 102(e) Date: Mar. 23, 1998

(87) PCT Pub. No.: WO97/44098

PCT Pub. Date: Nov. 27, 1997

(30) Foreign Application Priority Data

| | | |
|---|---|---|
| May 22, 1996 | (JP) | 8-126973 |
| Oct. 30, 1996 | (JP) | 8-288131 |
| Oct. 30, 1996 | (JP) | 8-288136 |
| Dec. 17, 1996 | (JP) | 8-336667 |
| Mar. 3, 1997 | (JP) | 9-047590 |

(51) Int. Cl.[7] ..... A63B 37/02

(52) U.S. Cl. ..... 473/358; 473/372

(58) Field of Search ..... 473/372, 373, 473/375, 374, 355, 356

(56) References Cited

U.S. PATENT DOCUMENTS

| | | | | |
|---|---|---|---|---|
| 1,202,318 | * | 10/1916 | Roberts | 473/375 X |
| 1,568,514 | * | 1/1926 | Lewis | 473/358 X |
| 4,971,329 | | 11/1990 | Llort et al. . | |
| 5,452,898 | * | 9/1995 | Yamagishi et al. | 473/377 |
| 5,480,155 | * | 1/1996 | Molitor et al. | 473/372 |
| 5,944,621 | * | 8/1999 | Tsujinaka et al. | 473/370 |
| 5,980,395 | * | 11/1999 | Tsunoda et al. | 473/373 |
| 5,997,416 | * | 7/1998 | Maruko | 273/1 |

* cited by examiner

*Primary Examiner*—Stephen F. Gerrity
*Assistant Examiner*—Mitra Aryanpour
(74) *Attorney, Agent, or Firm*—Birch, Stewart, Kolasch & Birch, LLP

(57) ABSTRACT

A hollow golf ball comprising a hollow core and a cover layer that possesses good shot feel, an increased moment of inertia, and a high launch angle at the time of hitting. Immediately after impact, the hollow golf ball has a small spin amount. The specific hollow core reduces the rate of spin dumping between the ascending and descending of the ball, which results in increased flight distance. The hollow golf ball has a hollow core and a cover layer formed on the core, wherein the hollow core is composed of a hollow portion having a diameter of 5 to 30 mm and a core outer layer portion surrounding said hollow portion.

8 Claims, 6 Drawing Sheets

HOLLOW SOLID GOLF BALL

This application claims the benefit under 35 U.S.C. §371 of prior PCT International Application No. PCT/JP97/01718 which has an International filing date of May 22, 1997 which designated the United States of America, the entire contents of which are hereby incorporated by references.

TECHNICAL FIELD

The present invention relates to a solid golf ball comprising a hollow core and a cover layer. More particularly, it relates to a golf ball having good shot feel at the time of hitting, large inertia moment, large launch angle at the time of hitting and increased flight distance.

TECHNICAL BACKGROUND

In the prior art, there are two kinds of golf balls. The one is a solid golf ball, such as a two-piece solid golf ball, which is composed of a core of an integrally molded rubber member and a thermoplastic resin (e.g. ionomer resin, etc.) covered on the core. The other is a thread wound golf ball and is obtained by winding thread rubber on a solid or liquid center and covering it with a cover of an ionomer resin, balata, etc. having a thickness of 1 to 2 mm. The two-piece solid golf ball is used by many golfers, particularly amateur golfers, because of good durability, longer flight distance attained by high ball velocity at the time of hitting and excellent flight performance in comparison with the thread wound golf ball. On the other hand, the two-piece solid golf ball has a problem wherein the shot feel at the time of hitting is hard.

In order to improve the drawback of the two-piece solid golf ball, softening the cover or the core has been suggested, but the softening adversely lowers the rigidity of the golf ball and reduces the impact force of the golf ball at the time of hitting, which results in a reduction in flight distance.

In addition, in order to improve this drawback, it has been tried to make the core and the cover of multiple layers. However, a two piece solid golf ball having satisfactory performance has not yet been obtained.

In order to improve the shot feel of a solid golf ball, a hollow portion golf ball having a hollow core at its center has been proposed in Japanese Utility Model Publication No. 3(1992)-63354. By forming a hollow portion in the center of the golf ball, the weight is disposed to the outside of the golf ball to increase moment of inertia, thereby making it possible to increase the flight distance. Since the hollow portion is present at its center, the impact force at the time of hitting can also be reduced.

Although it is actually possible to increase the moment of inertia by forming a hollow portion inside of the golf ball, the golf ball weight is undesirably reduced. To compensate for the ball weight, the rubber composition for the golf ball is made heavier or with a higher specific gravity by adding thereto a larger amount of a filler. The formulation of a filler in a larger amount adversely decreases the rubber content in the rubber composition to result in the degradation of the rebound characteristics. With respect to the impact force upon hitting, providing a hollow portion inside of the golf ball increases the deformation of the golf ball upon hitting and reduces the impact force, thus reducing the shot feel upon hitting. However, the larger the deformation of the golf ball, the larger the energy loss which often degrades the rebound characteristics.

SUMMARY OF THE INVENTION

An object of the present invention is to solve the above problems of the conventional two-piece solid golf ball and to provide a solid golf ball having good shot feel at the time of hitting without deteriorating the excellent flight performance inherent in the two-piece solid golf ball.

As a result, the present inventors have found that, by employing a hollow core (5) composed of a hollow portion (1) having a diameter of 5 to 30 mm and a hollow core outer layer portion (2), the shot feel at the time of hitting is improved and the moment of inertia increases, which results in a high launch angle and a small spin amount immediately after hitting. In addition, the specific hollow core reduces the rate of spin dumping between the ascending of the ball and descending, which increases flight distance.

When a golf ball is hit with a golf club, spin is applied on the golf ball and lifting power acts on the golf ball in the normal direction to the flight curve of the golf ball due to the spin. However, when the ball is ascending, the partial force of the lifting power in the horizontal direction acts negative to the ball's flight direction. The lifting power reduces ball speed, althought the ball speed is very high immediately after hitting. However, after the ball passes the highest point of the flight curve of the golf ball and is descending to the ground, the lifting power caused by the spin acts positively to the ball flight direction in a partial force in the horizontal direction of the lifting power. Accordingly, a large lifting power at the time the ball is descending is preferable for increasing the flight distance. In order to increase the flight distance of the golf ball, it is preferred that the spin is small at the time the ball is ascending, immediately after hitting and the spin is large at the time the ball is descending. For perfecting the above function, it is more preferred that the moment of inertia of the golf ball is large.

The present invention will become more fully understood from the detailed description given hereinbelow and the accompanying drawings which are given by way of illustration only, and thus are not limitative of the present invention, and wherein:

DETAILED DESCRIPTION OF THE INVENTION

The present invention relates to a hollow solid golf ball comprising a hollow core (5) and a cover layer (6) formed on the core, wherein the hollow core is composed of a hollow portion (1) having a diameter of 5 to 30 mm in its center and a hollow core outer layer portion (2) other than the hollow portion.

Figure 1:
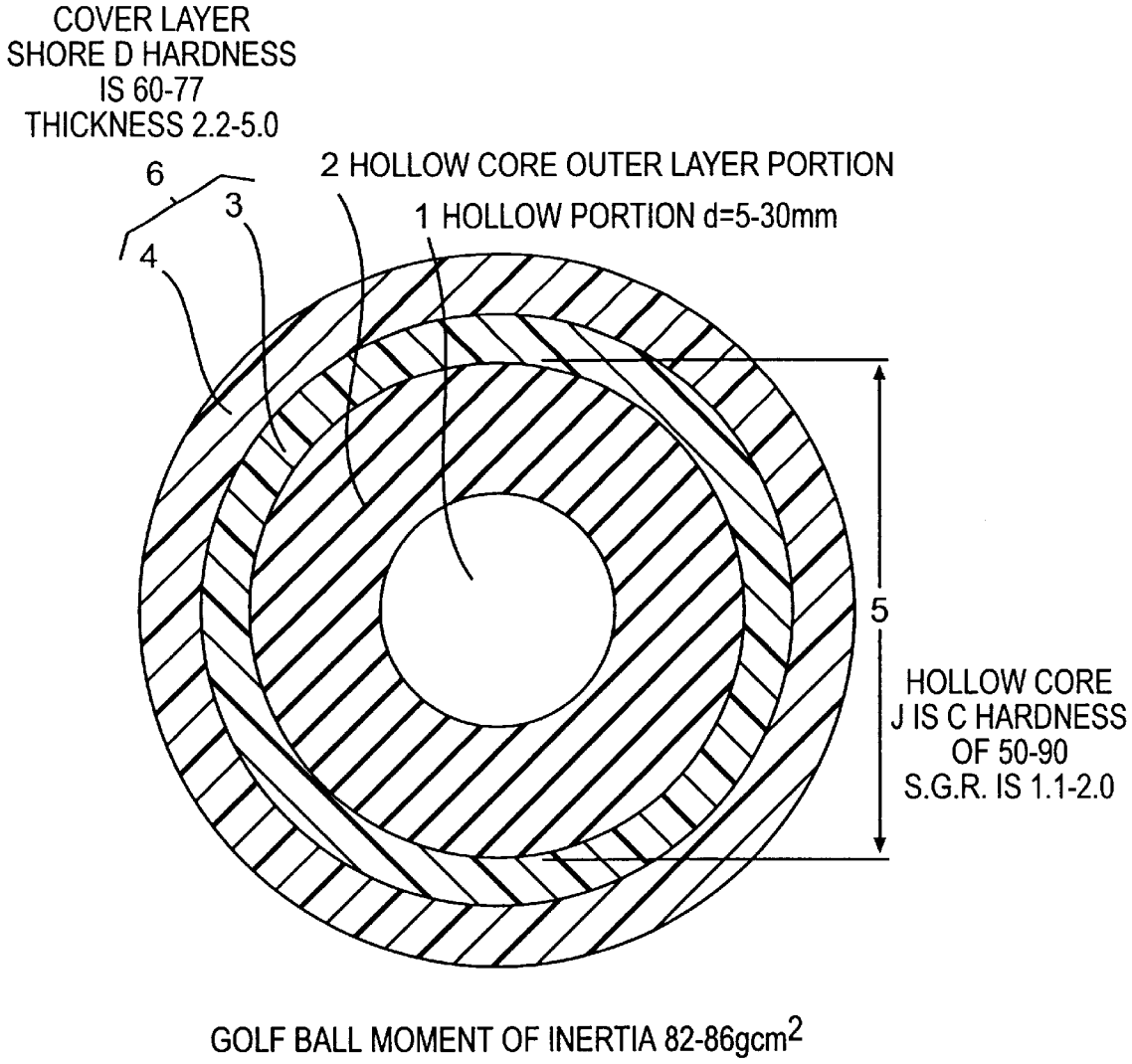
FIG. 1 is a schematic sectional view illustrating a golf ball of the present invention.

The present invention will be described in detail hereinafter. As shown in FIG. 1, the golf ball of the present invention comprises a hollow core (5) composed of a hollow portion (1) and a hollow core outer layer portion (2), and a cover layer (6) formed on the core. The larger the diameter of the hollow portion of the hollow core, the larger the moment of inertia of the golf ball, but it is preferred that the hollow portion has a diameter of 5 to 30 mm, more preferably 5 to 22 mm, because the reduction of the proportion of the vulcanized molded article layer of the rubber composition adversely affects the impact resilience. When the diameter is larger than 30 mm, it is necessary to use a large amount of the filler in the hollow core outer layer portion to adjust the specific gravity. On the other hand, when the diameter is smaller than 5 mm, the effect of the presence of the hollow portion is not realized. As the hollow core generally has a core diameter of from 37 to 39.5 mm, then the thickness of the hollow core outer layer portion is from 3.5 to 17.25 mm. The golf ball of the present invention preferably has a moment of inertia of 81 to 86 $gcm^2$. When the moment of inertia is smaller than 81 $gcm^2$, launch spin amount increases so that spin retention rate is reduced and flight distance is lowered. Accordingly, the moment of inertia is preferably not less than 82 $gcm^2$, more preferably not less than 83 $gcm^2$. When it is larger than 86 $gcm^2$, the diameter of the hollow portion must be increased and rebound characteristics are poor. Therefore, the moment of inertia more preferably is not more than 84 $gcm^2$.

Figure 2:
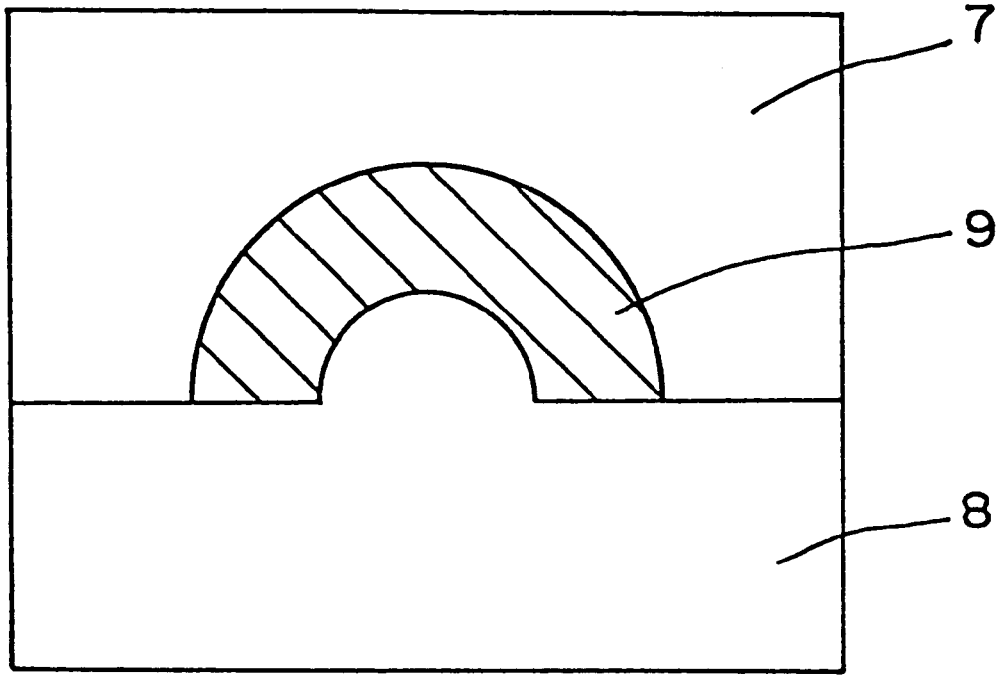
FIG. 2 is a schematic sectional view illustrating a mold for molding the hollow core of the golf ball of the present invention.

The method of producing the hollow core of the present invention can be any method known to the art, but it includes, for example, a method using a semi-spherical mold (7) and a core mold (8) shown in FIG. 2, wherein a rubber composition is inserted into the semispherical mold (7), compressed in the core mold (8), vulcanized at 150 to 170° C. for 20 minutes to form a half-shell molded article (9), and then two of the half-shell molded articles are bonded together to obtain a hollow core. The hollow core may also be prepared by a method wherein a hollow sphere is produced and then put between the above described half-shells to bond together to obtain a hollow core, but the method is not limited thereto. In the latter method, the hollow sphere having a thickness of 1 to 5 mm and a diameter of 6 to 20 mm is produced by bonding together two semi-spheres of the rubber composition or by the blow-injection-molding of a thermoplastic resin. In the production of the hollow sphere, a liquid center which has been known in the art may be made and then the liquid in the liquid center may be removed by using an injector. In this case, the injection hole made by the injector is sealed with a rubber sheet on which an adhesive is coated. Subsequently, a sphere having a thickness of 3 to 17 mm and a diameter of 36 to 41 mm is made from an unvulcanized rubber composition. When the thickness of the sphere is smaller than 3 mm, durability is poor. On the other hand, when the thickness exceeds 17 mm, the diameter of the hollow portion is not more than 5 mm, and therefore the moment of inertia is small and no technical effect is obtained. The above hollow sphere is inserted in the center of two of the semi-spheres and then put in a spherical mold, followed by vulcanizing at a temperature of 150 to 170° C. to obtain a hollow core. The semi-sphere can be obtained by inserting a rubber composition into a semispherical mold maintained previously at 110 to 130° C. and compressing using a semispherical metal core.

The hollow core obtained by vulcanizing as described above preferably has a JIS C hardness (equivalent to Shore C hardness) of 50 to 90, more preferably from 60 to 85. When the JIS C hardness is smaller than 50, the core is too soft and rebound characteristics are deteriorated. On the other hand, when it exceeds 90, the core is too hard and shot feel is deteriorated.

The specific gravity of the outer layer portion of the hollow core must be slightly higher than that of the core of a conventional golf ball. This is because the hollow portion is present and the specific gravity is made higher to compensate for the loss of weight of the hollow portion. Since the specific gravity of a conventional golf ball is from 1.0 to 1.17, the specific gravity of the hollow core of the present invention would preferably be within the range of from 1.1 to 2.0.

The hollow core outer layer portion (2) is obtained by compressing and molding at an elevated temperature a rubber composition containing a base rubber, a metal salt of an unsaturated carboxylic acid, an organic peroxide and a filler.

The base rubber can be natural rubber and/or synthetic rubber, which has hitherto been used for solid golf balls. Among them, a so-called high-cis polybutadiene rubber having a cis-1,4-structure of at least 90%, preferably at least 95%, is preferable. If necessary, the polybutadiene rubber may be mixed with natural rubber, polyisoprene rubber, styrene-butadiene rubber, EPDM (ethylene-propylene-diene rubber), etc.

The metal salt of the unsaturated carboxylic acid acts as a co-crosslinking agent, and examples thereof are monovalent or divalent metal salts (e.g. zinc salt, magnesium salt, etc.) of $\alpha$, $\beta$-unsaturated carboxylic acids having 3 to 8 carbon atoms, such as acrylic acid, methacrylic acid, etc. Among them, zinc acrylate capable of imparting high rebound characteristics is particularly preferable. The amount of the co-crosslinking agent is from 20 to 60 parts by weight, preferably from 30 to 50 parts by weight, based on 100 parts by weight of the base rubber. When the amount is larger than 60 parts by weight, the core is too hard and shot feel is poor. On the other hand, when the amount is smaller than 20 parts by weight, the rebounds characteristics are degraded and the flight distance is lowered. The amount may be adjusted to impart the desired elasticity according to the size of the hollow diameter, the kind of the cover material, etc.

The organic peroxide acts as a crosslinking agent or curing agent, and examples thereof are dicumyl peroxide, 1,1-bis(t-butylperoxy)- 3,5-trimethylcyclohexane, 2,5-dimethyl-2,5-di(t-butylperoxy)hexane, di-t-butyl peroxide and the like. Among them, dicumyl peroxide is preferable. An amount of the crosslinking agent is within the range of from 0.1 to 3.0 parts by weight, preferably from 0.3 to 2.5 parts by weight, based on 100 parts by weight of the base rubber. When the amount is smaller than 0.1 parts by weight, the core is too soft and rebound characteristics are poor and flight distance is lowered. On the other hand, when it exceeds 3.0 parts by weight, the shot feel is poor.

The low-specific gravity filler may be any one which is generally blended in the core of the golf ball, and examples thereof are inorganic salts, such as zinc oxide, barium sulfate, calcium carbonate and the like. In the present invention, zinc oxide is particularly used in the present invention. The high-specific gravity filler preferably has a specific gravity of 8 to 20, and examples thereof are metal powders, metal oxides, metal nitrides, etc. or a mixture thereof. Specific examples thereof are tungsten (specific gravity 19.3), tungsten carbide (specific gravity 15.8), molybdenum (specific gravity 10.2), lead (specific gravity 11.3), lead oxide (specific gravity 9.3), nickel (specific gravity 8.9), copper (specific gravity 8.9) or a mixture thereof. Since the hollow core (5) used in the present invention tends to lack weight compared with a conventional solid core, it is preferable to use a mixture of the low-specific gravity filler and the high-specific gravity filler. An amount of the combination of low and high specific gravity filler is preferably from 5 to 110 parts by weight based on 100 parts by weight of the base rubber, respectively. When the amount is smaller than 5 parts by weight, it is difficult to adjust the weight of the golf ball. On the other hand, when the amount exceeds 110 parts by weight, the weight ratio of the rubber component in the vulcanized rubber is small and the rebound characteristics are reduced too much.

Then, the hollow core (5) is covered with the cover layer (6). The cover can be formed from an ionomer resin which has been generally used as cover material of the solid golf ball, and a small amount of other resins may be added. The ionomer resin can be prepared by neutralizing a portion of carboxylic acid in a copolymer of ethylene and (meth) acrylate with metal ion, or a mixture thereof. Examples of the metal ion for neutralization include alkali metal ion, such as Na ion, K ion, Li ion, etc.; divalent metal ion such as Zn ion, Ca ion, Mg ion, etc.; trivalent metal ion such as Al ion, Nd ion, etc.; and a mixture thereof. Among them, Na ion, Zn ion, Li ion, etc, are often used in view of rebound characteristics, durability, etc. Specific examples of the ionomer resin are Hi-milan 1557, 1605, 1652, 1705, 1706, 1707, 1855 and 1856 (manufactured by Mitsui Du Pont Polychemical Co.); and IOTEC 7010 and 8000 (manufactured by Exxon Co), but are not limited thereto.

The cover in the present invention can be formed by using a generally known method used in the formation of covers for golf balls, for example, injection molding, press molding, etc. A thickness of the cover layer may be within the range of from 2.2 to 5.0 mm, preferably from 3.0 to 5.0 mm. In the present invention, when the thickness of the cover layer is adjusted to a thicker range, e.g. 2.2 to 5.0 mm, the rebound characteristics and durability are improved without increasing the impact force. On the other hand, when the thickness of the cover layer is smaller than 2.2 mm, the durability and shot feel at the time of hitting are relatively poor. On the other hand, when it exceeds 5.0 mm, the rebound characteristics are degraded because of the zinc oxide filled for adjusting the specific gravity and the shot feel at the time of hitting also is poor. Also, a shore D hardness of the cover layer is ranged from 60 to 77, preferably from 65 to 75. When the Shore D hardness of the cover layer is smaller than 60, durability is deteriorated and, therefore, the golf ball is easily damaged by scratching at the time of hitting. On the other hand, when it exceeds 77, shot feel at the time of hitting is poor. When covering the cover layer, a lot of recesses referred to as "dimples" are generally formed on the surface. The golf ball of the present invention is put on the market after coating with paint to enhance the appearance and commercial value.

The above cover layer (6) may have a two-layer cover structure of an inner cover layer (3) and an outer cover layer (4), as shown in FIG. 1. In this case, the above hollow core is covered with a cover composed of two layers, i.e., an inner cover layer (3) and an outer cover layer (4). The cover can be formed from the ionomer resin which has been generally used as the cover material of the solid golf ball, like the above-described cover having a single-layer structure, and a small amount of other resins may be added.

The inner layer cover (3) may contain the high-specific gravity filler such as tungsten powder, molybdenum powder, etc. or a mixture thereof, and have a specific gravity of 1 to 3. When the specific gravity of the inner cover layer (3) is smaller than 1, moment of inertia does not increase and, therefore, flight distance is lowered. The specific gravity is preferably not less than 1.05, more preferably not less than 1.1, most preferably not less than 1.2. When it is larger than 3, the amount of the high-specific gravity filler added is large and, therefore, the weight ratio of the rubber content of the core is lowered and rebound characteristics are deteriorated. Therefore, the specific gravity is not more than 1.9, more preferably. The amount of the high-specific gravity filler may be preferably from 5 to 90 parts by weight based on 100 parts by weight of the base resin. When the amount is smaller than 5 parts by weight, the specific gravity of the inner cover does not increase. On the other hand, when it exceeds 90 parts by weight, the specific gravity of the inner cover is too high.

Like the cover having a single-layer structure, the cover composition for the two-layer structure may contain additives for coloring, such as titanium dioxide, etc., and other additives such as ultraviolet absorbers, photostabilizers and fluorescent materials or fluorescent whiteners as far as the desired characteristics of the golf ball cover are not adversely affected. Like the cover having a single-layer structure, this cover layer can also be formed by a generally known method used in the formation of the cover of the golf ball, for example, injection molding, press molding, etc. At the time of covering the cover layer, a lot of recesses referred to as "dimples" are generally formed on the surface. The golf ball of the present invention is put on the market after coating with paint to enhance the appearance and commercial value.

EXAMPLES

The present invention will be illustrated by the following Examples which do not limit the present invention.

I

Production of Hollow Core

A hollow core having a diameter of 39 mm was obtained by charging each of rubber compositions shown in Table 1 in both semispherical molds for core press, interposing a semispherical protrusion type core mold having each hollow diameter between the molds, pre-molding at 155° C. for 10 minutes, removing the core mold, and vulcanizing at 155° C. for 30 minutes.

TABLE 1

Rubber formulation for core (Parts by weight)

| | Example No. | | | | | | Comparative Example No. | |
|---|---|---|---|---|---|---|---|---|
| Kind | 1 | 2 | 3 | 4 | 5 | 6 | 1 | 2 |
| BR-18 (Note 1) | 100 | 100 | 100 | 100 | 100 | 100 | 100 | 100 |
| Zinc acrylate | 37 | 37 | 37 | 37 | 37 | 37 | 37 | 37 |
| Zinc oxide | 5 | 5 | 5 | 5 | 5 | 52 | 15.2 | 52 |
| Tungsten | 12.3 | 14.8 | 25.8 | 37.9 | 80 | 106.0 | — | 190 |
| Antioxidant (Note 2) | 0.5 | 0.5 | 0.5 | 0.5 | 0.5 | 0.5 | 0.5 | 0.5 |
| Dicumyl peroxide | 1 | 1 | 1 | 1 | 1 | 1 | 1 | 1 |
| Hollow diameter (mm) | 5 | 10 | 15 | 20 | 25 | 30 | 0 | 35 |

(Note 1): High-cis-1,4-polybutadiene, manufactured by JSR Co, Ltd.
(Note 2): Yoshinox 425, manufactured by Yoshitomi Seiyaku Co., Ltd.

Examples 1 to 6 and Comparative Examples 1 to 2

A hollow solid golf ball having a diameter of 42.7 mm was obtained by covering the hollow core thus obtained above with a cover composition of the formulation shown in Table 2 to form a cover layer, followed by coating with paint, respectively.

TABLE 2

Cover formulation

| Kind | Parts by weight |
|---|---|
| Hi-milan #1605 (Note 3) | 50 |
| Hi-milan #1706 (Note 4) | 50 |
| Titanium dioxide | 2 |

(Note 3): Ethylene-methacrylic acid copolymer ionomer resin prepared by neutralizing with sodium ion, manufactured by Mitsui Du Pont Polychemical Co., Ltd.
(Note 4): Ethylene-methacrylic acid copolymer ionomer resin prepared by neutralizing with zinc ion, manufactured by Mitsui Du Pont Polychemical Co., Ltd.

With respect to the resulting golf balls, the flight performance by a driver (No. 1 wood club) and shot feel at the time of hitting were evaluated. The results are shown in Table 3. The test method was as follows.

Test method (1) Launch angle, spin amount, initial velocity and flight distance A driver was attached to a swing robot manufactured by True Temper Co. and a golf ball was hit at a head speed of 45 m/second. The launch angle (trajectory height) and initial velocity were measured. The distance (carry) to the dropped point on the ground was measured as flight distance. The spin amount was determined by taking continuous photographs of the hit golf ball.

(2) Moment of inertia

It was measured by using an apparatus of model No.005-002 series No. M99274 manufactured by INERTIA DYNAMICS Co.

(3) Impact force

A driver was attached to a swing robot manufactured by True Temper Co. and a golf ball was hit at a head speed of 45 m/second. A detector of acceleration was attached to the rear portion of the club head and an acceleration arising in a direction which was opposite to the flight direction of the head was measured. The impact force was determined by converting the maximum value of the acceleration into force (F (impact force) is determined by the equation $F=M\alpha$, where $\alpha$ is maximum acceleration and M is a head weight).

Test results

TABLE 3

| Test item | Example No. 1 | 2 | 3 | 4 | 5 | 6 | Comparative Example No. 1 | 2 |
|---|---|---|---|---|---|---|---|---|
| Hollow diameter (mm) | 5 | 10 | 15 | 20 | 25 | 30 | 0 | 35 |
| Ball initial velocity (m/second) | 61.0 | 60.7 | 60.4 | 59.6 | 59.0 | 58.5 | 61.5 | 57.5 |
| Launch angle (°) | 11.27 | 11.45 | 11.45 | 11.67 | 11.72 | 11.80 | 10.73 | 11.10 |
| Spin amount (rpm) | 2880 | 2770 | 2720 | 2660 | 2605 | 2500 | 3050 | 2530 |
| Flight distance (yard) | 229.3 | 231.5 | 230.1 | 229.8 | 228.5 | 228.4 | 225.0 | 215.3 |
| Moment of inertia ($gcm^2$) | 80.5 | 81.0 | 83.5 | 85.2 | 91.0 | 97.0 | 80.0 | 69.35 |
| Maximum impact force (kg) | 1124 | 1008 | 990 | 962 | 942 | 932 | 1302 | 922 |

Figure 5:
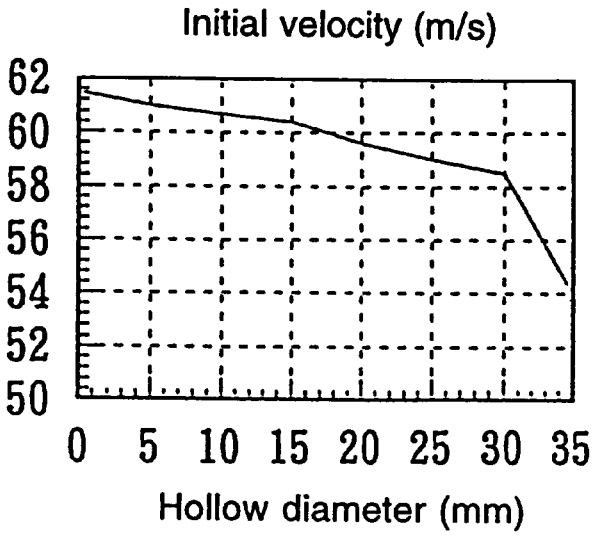
FIG. 5 is a graph illustrating the relationship between the initial velocity and the hollow diameter of the golf ball evaluated in the Examples.
Figure 6:
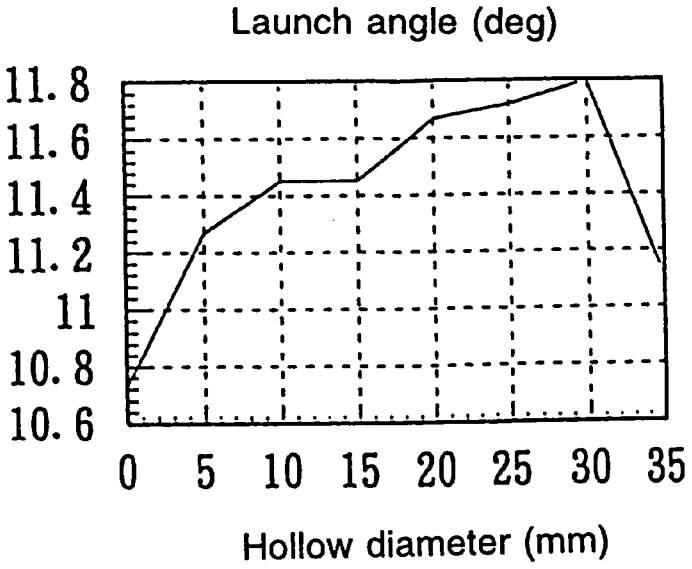
FIG. 6 is a graph illustrating the relationship between the launch angle and the hollow diameter of the golf ball evaluated in the Examples.
Figure 7:
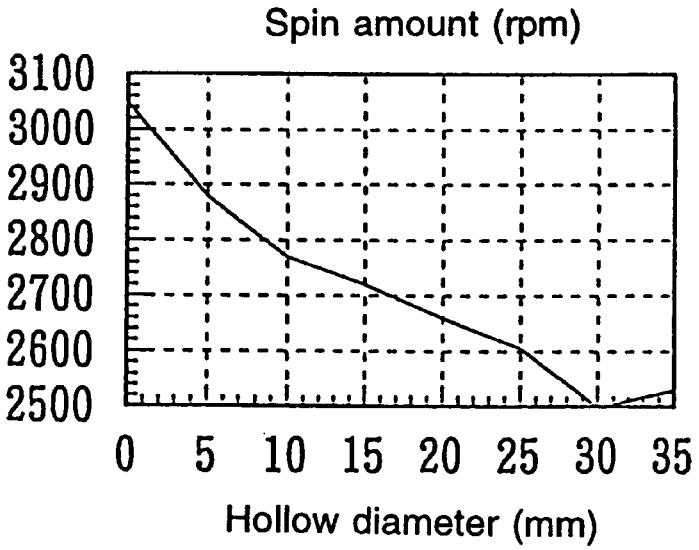
FIG. 7 is a graph illustrating the relationship between the spin amount and the hollow diameter of the golf ball evaluated in the Examples.
Figure 8:
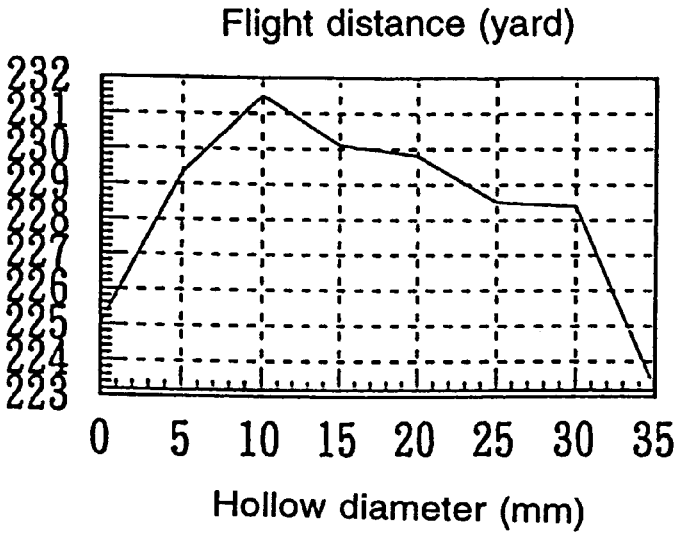
FIG. 8 is a graph illustrating the relationship between the flight distance and the diameter of the hollow portion of the golf ball evaluated in the Examples.
Figure 9:
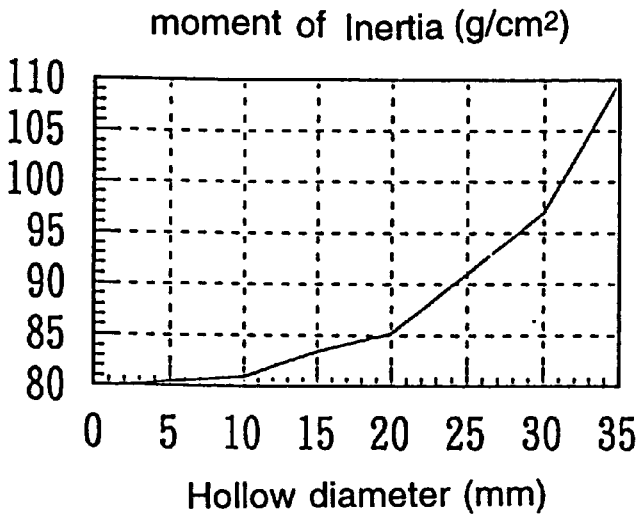
FIG. 9 is a graph illustrating the relationship between the moment of inertia and the hollow diameter of the golf ball evaluated in the Examples.
Figure 10:
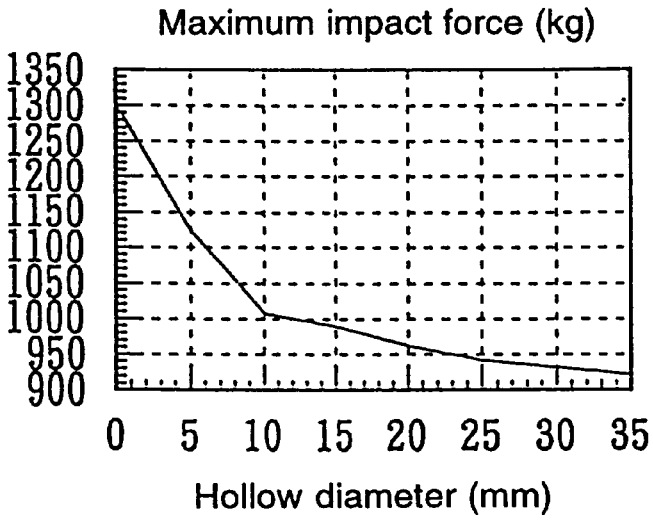
FIG. 10 is a graph illustrating a relation between maximum impact force and hollow diameter of the golf ball evaluated in Examples.

FIGS. 5 to 10 are graphs for easier understanding of a relation between the above hollow diameter and respective characteristics. FIG. 5 illustrates a relation between hollow diameter and initial velocity, wherein the coordinate represents the initial velocity while the abscissa represents the hollow diameter. Similarly, FIG. 6 illustrates a relation between hollow diameter and launch angle, FIG. 7 illustrates a relation between hollow diameter and spin amount, FIG. 8 illustrates a relation between flight distance and hollow diameter, FIG. 9 illustrates a relation between hollow diameter and moment of inertia, and FIG. 10 illustrates a relation between hollow diameter and maximum impact force. When the hollow diameter is within the range of from 5 to 30 mm, small impact force, good shot feel at the time of hitting, large launch angle, small spin amount, large moment of inertia and long flight distance are recognized in comparison with the case that the hollow diameter is smaller than 5 mm. When the hollow diameter exceeds 30 mm, small impact force, good shot feel at the time of hitting, large launch angle, small initial velocity, small launch angle and short flight distance are recognized.

It was recognized by the above results that the hollow solid golf balls having a hollow diameter of 5 to 30 mm of Examples 1 to 6 attain small impact force, good shot feel at the time of hitting, large launch angle at the time of hitting, small spin amount, large moment of inertia and long flight distance in comparison with the conventional solid golf ball without hollow of Comparative Example 1. it was recognized that the solid golf ball having larger hollow diameter of Comparative Example 2 attains large impact force, good shot feel at the time of hitting, large launch angle at the time of hitting, large moment of inertia, small initial velocity, small launch angle and short flight distance.

II

Production of Hollow Rubber Sphere

A hollow rubber semi-sphere having a rubber thickness of 2 mm was produced by vulcanization molding a rubber composition of the formulation shown in Table 4 below at 155° C. for 15 minutes. As the diameter of the hollow portion, four kinds of diameters were set as shown in Table 5. A hollow rubber sphere was produced by pre-bonding two hollow semi-spheres, followed by vulcanization-bonding at 155° C. for 20 minutes. In the production of the hollow rubber sphere, a generally known liquid center was made and then liquid in the liquid center might be removed by using an injector. In that case, an injection hole was sealed with a rubber sheet coated with an adhesive.

Production of Hollow Core

A hollow core having a diameter of 38.5 mm was obtained by charging each of rubber compositions shown in Table 5 in both semispherical molds for core press, interposing a semispherical protrusion type core mold having each hollow diameter between the molds, pre-molding at 165° C. for 2 minutes, removing the core mold, and vulcanizing at 165° C. for 20 minutes.

TABLE 4

| Rubber formulation for hollow sphere | (Parts by weight) |
|---|---|
| BR-18 (Note 1) | 100 |
| Zinc acrylate | 36 |
| Zinc oxide | 5 |
| Antioxidant (Note 2) | 1 |
| Dicumyl peroxide | 1 |

TABLE 5

| | Rubber formulation for core (Parts by weight) | | | | | | | | |
|---|---|---|---|---|---|---|---|---|---|
| | Example No. | | | | | | | | Comparative Example No. |
| Kind | 7 | 8 | 9 | 10 | 11 | 12 | 13 | 14 | 3 |
| BR-18 (Note 1) | 100 | 100 | 100 | 100 | 100 | 100 | 100 | 100 | 100 |
| Zinc acrylate | 30 | 34 | 36 | 40 | 60 | 20 | 70 | 34 | 36 |

TABLE 5-continued

| | Rubber formulation for core (Parts by weight) | | | | | | | | |
|---|---|---|---|---|---|---|---|---|---|
| | Example No. | | | | | | | | Comparative Example No. |
| Kind | 7 | 8 | 9 | 10 | 11 | 12 | 13 | 14 | 3 |
| Zinc oxide | 17.4 | 10.2 | 10 | 100 | 10 | 10.2 | 10.2 | 110 | 21 |
| Tungsten | 5 | 20 | 36.4 | 107.6 | 13.8 | 25 | 13.8 | 110 | 0 |
| Antioxidant (Note 2) | 0.5 | 0.5 | 0.5 | 0.5 | 0.5 | 0.5 | 0.5 | 0.5 | 0.5 |
| Dicumyl peroxide | 0.3 | 0.3 | 0.3 | 0.3 | 0.3 | 0.3 | 2.0 | 0.3 | 0.3 |
| Hollow diameter (mm) | 5 | 15 | 20 | 30 | 15 | 15 | 15 | 30 | 0 |

(Note 1): Hi-cis-1,4-polybutadiene, manufactured by JSR Co. Ltd.
(Note 2): Yoshinox 425, manufactured by Yoshitomi Seiyaku Co., Ltd.

Examples 7 to 14

A hollow solid golf ball having a diameter of 42.7 mm was produced by covering the hollow core thus obtained above with a cover composition of the formulation shown in Table 6 to form a cover layer, followed by coating with paint.

TABLE 6

| Kind | Parts by weight |
|---|---|
| Hi-milan #1605 (Note 3) | 50 |
| Hi-milan #1706 (Note 4) | 50 |
| Titanium dioxide | 2 |

(Note 3): Ethylene-methacrylic acid copolymer ionomer resin prepared by neutralizing with sodium ion, manufactured by Mitsui Du Pont Polychemical Co., Ltd
(Note 4): Ethylene-methacrylic acid copolymer ionomer resin prepared by neutralizing with zinc ion, manufactured by Mitsui Du Pont Polychemical Co., Ltd.

Comparative Example 3

A solid core having a diameter of 38.5 mm was obtained by press-vulcanizing a rubber composition of the formulation shown in Table 5. According to the same manner as that described in Examples 7 to 14, a solid golf ball having a diameter of 42.7 mm was produced by forming a cover layer, followed by coating with paint.

With respect to the resulting golf balls, the moment of inertia, flight distance (carry), launch angle, launch spin amount and durability were evaluated. The results are shown in Table 7. The test method was as follows.

Test method (1) Moment of inertia

It was measured by using model No.005-002 series No. M99274 manufactured by INERTIA DYNAMICS Co.

(2) Impact force

A driver was attached to a swing robot manufactured by True Temper Co. and a golf ball was hit at a head speed of 45 m/second. In this case, an accelerator was attached to the club head rear portion and an acceleration arising in the direction, which was opposite to the running direction of the head, was measured. The impact force was determined by converting the maximum value of the acceleration into a force.

(3) Flight distance

A driver was attached to a swing robot manufactured by True Temper Co. and a golf ball was hit at a head speed of 45 m/second. The distance (carry) to the dropped point on the ground was measured as flight distance.

(4) Launch angle and launch spin amount

A photograph at the time of impact between a golf ball and a club head was taken by two cameras arranged with a fixed interval by staggering a fixed time, and they were calculated by the difference.

(5) Durability

A driver was attached to a swing robot manufactured by True Temper Co. and a golf ball was hit at a head speed of 45 m/second 50 times. It was observed whether cracking occurred or not.

○: No cracking occurs after 50 times.

x: Cracking occurs within 50 times.

(6) Shot feel at the time of hitting

Ten professional golfers hit golf balls using a driver and evaluated. The evaluation criteria are as follows.

Evaluation criteria

◎: Eight or more golfers replied "good".

○: Five to seven golfers replied "good".

Δ: Two to four golfers replied "good".

x: One or less golfer replied "good".

Test results

TABLE 7

| | Example No. | | | | | | | | Comparative Example No. |
|---|---|---|---|---|---|---|---|---|---|
| Test item | 7 | 8 | 9 | 10 | 11 | 12 | 13 | 14 | 3 |
| Moment of inertia ($gcm^2$) | 79.83 | 82.40 | 85.71 | 93.22 | 82.40 | 82.42 | 82.38 | 93.22 | 79.72 |

TABLE 7-continued

| Test item | Example No. 7 | 8 | 9 | 10 | 11 | 12 | 13 | 14 | Comparative Example No. 3 |
|---|---|---|---|---|---|---|---|---|---|
| Maximum impact force (kg) | 1305 | 1177 | 1076 | 1041 | 1177 | 1160 | 1250 | 1305 | 1324 |
| Carry (yard) | 233.4 | 233.2 | 233.0 | 232.5 | 233.7 | 231.0 | 233.1 | 232.3 | 233.5 |
| Launch angle (degree) | 11.50 | 11.68 | 11.82 | 12.13 | 11.60 | 11.70 | 11.78 | 11.92 | 11.30 |
| Launch spin amount (rpm) | 3162 | 3030 | 3011 | 3006 | 3030 | 3041 | 3006 | 3041 | 3180 |
| Durability | ○ | ○ | ○ | ○ | ○ | ○ | ○ | ○ | ○ |
| Shot feel at the time of hitting | ○ | ◎ | ◎ | ◎ | ○ | ◎ | Δ | Δ | × |

It was recognized from the above results that the solid golf balls having a hollow core in its center and using the core composition suitable for the hollow core (Examples 7 to 14) of the present invention showed small impact force because of the hollow core and, therefore, soft and good shot feel at the time of hitting was obtained. Also, the golf balls showed large moment of inertia, low back spin amount and large launch angle, which resulted in longer flight distance in comparison with the solid golf ball of Comparative Example 3.

III

Production of Hollow Rubber Sphere

A hollow rubber semi-sphere having a rubber thickness of 2 mm was produced by vulcanization molding the rubber composition of the formulation shown in Table 4 at 160° C. for 20 minutes. As the diameter of the hollow portion, four kinds of diameters were set as shown in Table 8. A hollow rubber sphere was produced by bonding two hollow semi-spheres with an adhesive.

Production of Hollow Core

Like the hollow sphere, a semi-sphere was produced from the rubber composition shown in Table 8 below by using a semispherical mold and a semispherical protrusion type core at 130 to 150° C. Then, two of the above hollow sphere were interposed between two of the semi-spheres, and compression-vulcanized at 160° C. for 20 minutes to obtain a hollow core having a diameter of 38.5 mm.

TABLE 8

| Kind | Rubber formulation (Parts by weight) a | b | c | d | e | f | g |
|---|---|---|---|---|---|---|---|
| BR-18 (Note 1) | 100 | 100 | 100 | 100 | 100 | 100 | 100 |
| Zinc acrylate | 30 | 34 | 36 | 40 | 25 | 45 | 50 |
| Zinc oxide | 24.1 | 23.2 | 25.7 | 37.0 | 25.8 | 71 | 128 |
| Dicumyl peroxide | 1.0 | 1.0 | 1.0 | 1.0 | 1.0 | 1.0 | 1.0 |
| Core specific gravity | 1.168 | 1.171 | 1.189 | 1.259 | 1.168 | 1.440 | 1.910 |

(Note 1): High-cis-1,4-polybutadiene, manufactured by JSR Co. Ltd.

Examples 15 to 19 and Comparative Example 4

A hollow solid golf ball having a cover thickness of 2.2 mm and a diameter of 43.0 mm was produced by injection-molding a cover composition of the formulation shown in Table 9 onto the hollow core obtained above, followed by coating with two-package curing type urethane paint.

TABLE 9

| Kind | Parts by weight |
|---|---|
| Hi-milan #1605 (Note 3) | 100 |
| Titanium dioxide | 2 |

(Note 3): Ethylene-methacrylic acid copolymer ionomer resin prepared by neutralizing with sodium ion, manufactured by Mitsui Du Pont Polychemical Co., Ltd.

Comparative Example 5

A solid core having a diameter of 38.5 mm was obtained by compression-vulcanizing the rubber composition e of the formulation shown in Table 8 at 160° C. According to the same manner as that described in Examples 16 to 20 and Comparative Example 4, a solid golf ball having a cover thickness of 2.2 mm and a diameter of 42.7 mm was obtained by forming a cover layer and coating with paint.

With respect to the resulting golf balls, the total flight distance, launch spin amount, spin amount at 150 yard point, spin retention and moment of inertia were evaluated. The results are shown in Table 10. The test method was as follows.

Test method (1) Total flight distance

A driver was attached to a swing robot manufactured by True Temper Co. and a golf ball was hit at a head speed of 45 m/second. The total flight distance was measured.

(2) Launch spin amount and spin amount at 150 yard point

Figure 4:
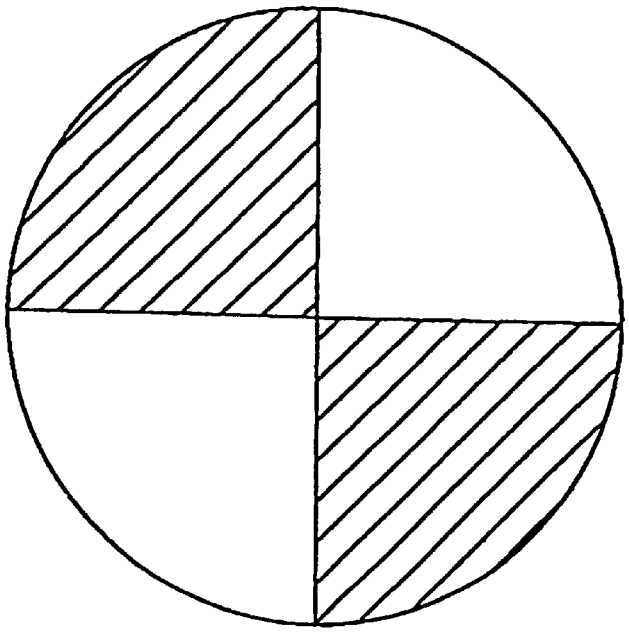
FIG. 4 is a schematic, sectional view illustrating a golf ball whose surface is separately coated with black and white paint for measuring spin.

A driver was attached to a swing robot manufactured by True Temper Co. and a golf ball was hit at a head speed of 45 m/second. The spin amount of the launched golf ball and spin amount at 150 yard point during the flight were measured. The measuring method was as follows. Four divided sections of the surface of the golf ball were separately coated with black and white paint as shown in FIG. 4. At the 150 yard point, a lamp for shining the golf ball upwards and a sensor for identifying black and white were set. A black/white timing axis waveform in case of passing through light was monitored by using an oscilloscope and a revolution per minute were determined from the waveform.

(3) Moment of inertia

Moment of inertia was measured by using an apparatus, model MOI-005-002, manufactured by INERTIA DYNAMICS Co.

Test results

TABLE 10

| Test item | Example No. 15 | 16 | 17 | 18 | 19 | Comparative Example No. 4 | 5 |
|---|---|---|---|---|---|---|---|
| Hollow portion diameter (mm) | 5 | 10 | 16 | 22 | 26 | 3 | — |
| Formulation for core | b | c | d | f | g | a | e |
| Total flight distance (yard) | 249 | 253 | 256 | 248.5 | 241.5 | 243 | 241 |
| Launch spin amount A (rpm) | 2863 | 2821 | 2765 | 2750 | 2760 | 2920 | 2950 |
| Spin amount at 150 yard point (rpm) | 2697 | 2674 | 2652 | 2612 | 2674 | 2689 | 2713 |
| Spin retention (B/A) (%) | 94.2 | 94.8 | 95.9 | 95.0 | 96.9 | 92.1 | 92.0 |
| Moment of inertia ($gcm^2$) | 82.0 | 83.3 | 84.1 | 85.8 | 92.8 | 80.5 | 80.3 |

It was confirmed by the above results that the golf balls having a hollow core (Examples 15 to 19) of the present invention showed large moment of inertia, small launch angle, large spin retention on flight and excellent flight distance by driver in comparison with the golf ball having small hollow diameter (Comparative Example 4) and solid golf ball of Comparative Example 5.

IV

Production of Hollow Core

A hollow semi-sphere was produced by charging each of rubber compositions of the formulation shown in Tables 11 and 12 in a mold as shown in FIG. 2, followed by vulcanization-molding at 155° C. for 40 minutes. After cooling, two of the semi-spheres were bonded with an adhesive to produce a hollow core.

TABLE 11

Rubber formulation for core (Parts by weight)

| Kind | A | B | C | D | E | F |
|---|---|---|---|---|---|---|
| BR-18 (Note 1) | 100 | 100 | 100 | 100 | 100 | 100 |
| Zinc acrylate | 31 | 31 | 31 | 31 | 31 | 31 |
| Zinc oxide | 16.7 | 27.8 | 35.8 | 42.1 | 55.3 | 67.1 |
| Antioxidant (Note 2) | 0.5 | 0.5 | 0.5 | 0.5 | 0.5 | 0.5 |
| Dicumyl peroxide | 1 | 1 | 1 | 1 | 1 | 1 |
| Hollow portion diameter (mm) | 10 | 10 | 10 | 10 | 10 | 10 |

TABLE 12

Rubber formulation for core (Parts by weight)

| Kind | G | H | I | J | K | L |
|---|---|---|---|---|---|---|
| BR-18 (Note 1) | 100 | 100 | 100 | 100 | 100 | 100 |
| Zinc acrylate | 31 | 31 | 31 | 31 | 31 | 31 |
| Zinc oxide | 52.5 | 58.5 | 75.6 | 89.4 | 121.6 | 159.8 |
| Antioxidant (Note 2) | 0.5 | 0.5 | 0.5 | 0.5 | 0.5 | 0.5 |
| Dicumyl peroxide | 1 | 1 | 1 | 1 | 1 | 1 |

TABLE 12-continued

Rubber formulation for core (Parts by weight)

| Kind | G | H | I | J | K | L |
|---|---|---|---|---|---|---|
| Hollow portion diameter (mm) | 20 | 20 | 20 | 20 | 20 | 20 |

(Note 1): High-cis-1,4-polybutadiene, manufactured by JSR Co. Ltd.
(Note 2): Yoshinox 425, manufactured by Yoshitomi Seiyaku Co., Ltd.

Examples 20 to 27 and Comparative Examples 6 to 9

On the hollow core obtained above, a cover composition prepared by mixing titanium dioxide with ionomer resin in an amount of 2 parts by weight based on 100 parts by weight of the ionomer resin, the ionomer resin being a 50/50 mixture of Hi-milan 1605 and Hi-milan 1706 (both manufactured by Mitsui Polychemical Co., Ltd.) was covered in the cover thickness and cover hardness (Shore-D scale) shown in Table 13 and Table 14 to form a cover layer, which was then coated with paint to obtain a hollow solid golf ball having a diameter of 42.7 mm. The total weight of the golf ball was adjusted to 45.4 g by changing the amount of zinc oxide to be charged in the rubber composition of the hollow core.

With respect to the resulting golf balls, shot feel at the time of hitting, impact force, flight distance and durability were evaluated. The results are shown in Table 13 and Table 14. The test method was as follows.

Test method (1) Shot feel at the time of hitting

Amateur golfers with a handicap of 10 or less hit the golf ball using a driver and evaluated. The evaluation criteria are as follows.

Evaluation criteria

◎: Very soft and very good

○: Soft and good x: Hard and poor (2) Impact force A driver was attached to a swing robot manufactured by True Temper Co. and a golf ball was hit at a head speed of 45 m/second. In this case, an accelerator was attached to the club head at a rear portion and an acceleration arising in the direction, which was opposite to the running direction of the head, was measured. The impact force was determined by converting the maximum value of the acceleration into a force.

(3) Flight distance

A driver was attached to a swing robot manufactured by True Temper Co. and a golf ball was hit at a head speed of 45 m/second. The distance (carry) to the dropped point on the ground was measured as the flight distance.

(4) Durability test

A golf ball was allowed to impact against a block at a speed of 45 m/second, using an impact machine, and the impact time required to cause breakage was measured. The durability was evaluated by the following criteria.

◎: 150 times or more

○: 100 to 150 times x: 100 times or less

Test Results

TABLE 13

| | Example No. | | | | Comparative Example No. | |
|---|---|---|---|---|---|---|
| Test Item | 20 | 21 | 22 | 23 | 6 | 7 |
| Core formulation | B | C | D | E | A | F |
| Hollow core diameter (mm) | 10 | 10 | 10 | 10 | 10 | 10 |
| Cover thickness (mm) | 2.6 | 3.2 | 3.8 | 4.8 | 1.0 | 5.5 |
| Cover hardness (Shore D) | 68 | 68 | 68 | 68 | 68 | 68 |
| Flight performance #1 (45 m/second) | | | | | | |
| Shot feel at the time of hitting | ◎ | ◎ | ◎ | ◎ | ◎ | × |
| Maximum impact force (kg) | 1320 | 1330 | 1335 | 1340 | 1280 | 1410 |
| Total flight distance (yard) | 231.5 | 232.1 | 233.1 | 233.2 | 220.2 | 225.0 |
| Durability test | ○ | ◎ | ◎ | ◎ | × | ○ |

TABLE 14

| | Example No. | | | | Comparative Example No. | |
|---|---|---|---|---|---|---|
| Test Item | 24 | 25 | 26 | 27 | 8 | 9 |
| Core formulation | H | I | J | K | G | L |
| Hollow core diameter (mm) | 20 | 20 | 20 | 20 | 20 | 20 |
| Cover thickness (mm) | 2.6 | 3.2 | 3.8 | 4.8 | 1.0 | 5.5 |
| Cover hardness (Shore D) | 68 | 68 | 68 | 68 | 68 | 68 |
| Flight performance #1 (45 m/second) | | | | | | |
| Shot feeling at the time of hitting | ◎ | ◎ | ◎ | ◎ | ○ | × |
| Maximum impact force (kg) | 1100 | 1160 | 1240 | 1240 | 1080 | 1335 |
| Total flight distance (yard) | 229.5 | 230.4 | 230.9 | 231.1 | 219.6 | 223.2 |
| Durability test | ○ | ○ | ◎ | ◎ | × | ○ |

As is apparent from the above results, the hollow solid golf balls having a cover layer thickness of 2.2 to 5.0 mm (Examples 20 to 27) of the present invention show good shot feel at the time of hitting, good ball rebound performance and good ball durability. The golf balls having a thin cover layer thickness of Comparative Examples 6 and 8 show poor durability and poor rebound performance. Regarding the golf balls having thicker cover layer thickness of Comparative Examples 7 and 9, zinc oxide charged for controlling the specific gravity deteriorates rebound characteristics and shot feel at the time of hitting also is poor.

V

Production of Hollow Core

A hollow semi-sphere was produced by vulcanization-molding a rubber composition of the formulation shown in Table 15 below at 160° C. for 20 minutes using upper and lower molds (7), (8) shown in FIG. 2. As the diameter of the hollow portion, two kinds of diameters were set as shown in Table 17. A hollow core having a diameter of 37 mm was produced by bonding two of the hollow semi-spheres with a two-package type epoxy adhesive.

TABLE 15

| Kind | Rubber formulation for core (Parts by weight) | | | | | | | |
|---|---|---|---|---|---|---|---|---|
| | I | II | III | IV | V | VI | VII | VIII |
| BR-18 (Note 1) | 100 | 100 | 100 | 100 | 100 | 100 | 100 | 100 |
| Zinc acrylate | 25 | 25 | 25 | 25 | 25 | 25 | 25 | 25 |
| Zinc oxide | 22.3 | 49.5 | 21.7 | 12.0 | 27.8 | — | 17 | 68 |
| Dicumyl peroxide | 0.9 | 2.5 | 1.5 | 1.5 | 1.5 | 1.5 | 2.5 | 1.5 |
| Core specific gravity | 1.170 | 1.307 | 1.143 | 1.086 | 1.18 | 1.005 | 1.114 | 1410 |

(Note 1): High-cis-1,4-polybutadiene, manufactured by JSR Co. Ltd.

Examples 28 to 34

Molding of Cover (i) Inner cover layer

A sphere having a diameter of 40 mm was obtained by injection-molding a cover composition of the formulation shown in Table 16 onto the hollow core thus obtained above in a thickness of 1.5 mm.

(ii) Outer cover layer

A hollow solid golf ball having a diameter of 43 mm was produced by injection-molding a cover composition shown in Table 16 onto the inner cover layer so that the thickness was 1.5 mm and 400 dimples were provided on the surface, followed by coating with a two-package type urethane paint.

Comparative Example 10

Figure 3:
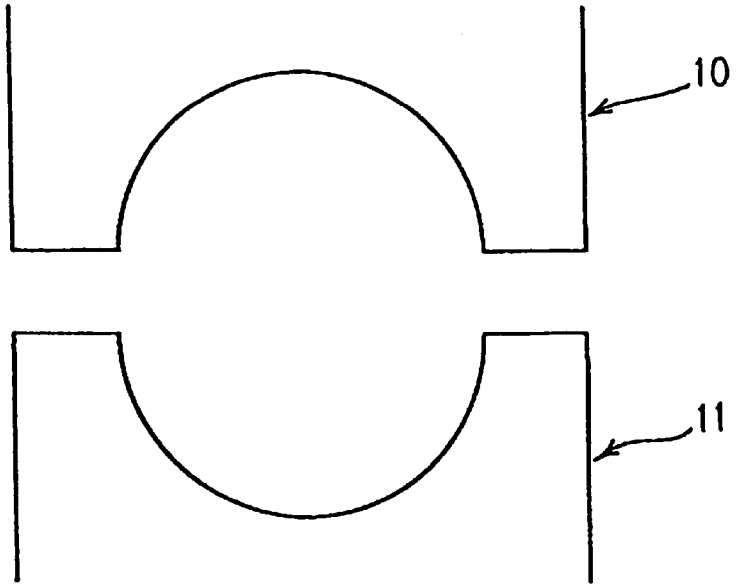
FIG. 3 is a schematic sectional view illustrating a mold for molding a solid core for a Comparative Example.

A solid core having a diameter of 38.4 mm was obtained by vulcanizaton-molding a rubber cover composition of the formulation I shown in Table 16, using semispherical upper and lower molds (10), (11) shown in FIG. 3. A solid golf ball having a diameter of 43 mm was produced by injection-molding a cover composition of the formulation e shown in Table 16 onto the resulting solid core so that the thickness was 2.3 mm and 400 dimples were provided on the surface, followed by coating with a two-package type urethane paint.

TABLE 16

| Kind | Rubber formulation for core (Parts by weight) | | | | | |
|---|---|---|---|---|---|---|
| | a | b | c | d | e | f |
| Hi-milan #1605 (Note 3) | 50 | 50 | 50 | 50 | 50 | 50 |
| Hi-milan #1706 (Note 4) | 50 | 50 | 50 | 50 | 50 | 50 |
| Titanium oxide | 0 | 0 | 0 | 0 | 3 | 0 |
| Tungsten powder | 0 | 17 | 41 | 77 | 0 | 8.5 |
| Cover specific gravity | 0.95 | 1.10 | 1.30 | 1.90 | 0.99 | 1.05 |

(Note 3): Ethylene-methacrylic acid copolymer ionomer resin prepared by neutralizing with sodium ion, manufactured by Mitsui Du Pont Polychemical Co., Ltd.
(Note 4): Ethylene-methacrylic acid copolymer ionomer resin prepared by neutralizing with zinc ion, manufactured by Mitsui Du Pont Polychemical Co., Ltd.

With respect to the resulting golf balls, the ball initial velocity, spin, spin damping during the flight, flight distance (carry) and shot feel were evaluated. The results are shown in Table 17. The test method was as follows.

Test method (1) Ball initial velocity, spin and carry

A driver (Dunlop DP914) was attached to a swing robot manufactured by True Temper Co. and a golf ball was hit at a head speed of 45 m/second. In this case, the ball initial velocity, spin and carry were measured.

(2) Spin damping during flight

A driver was attached to a swing robot manufactured by True Temper Co. and a golf ball was hit at a head speed of 45 m/second. The spin amount during the flight was measured. The measuring method was as follows. Four divided sections of the surface of the golf ball were separately coated with black and white paint as shown in FIG. 4. At the 140 yard point, a lamp for shining the golf ball upwards and a sensor for identifying black and white were set. A black/white timing axis waveform in case of passing through light was monitored by using an oscilloscope and a revolution per minute, i.e. spin, was determined from the period of the waveform by using the following equation.

$$\text{Spin (rpm)}=1/(\text{Period}\times 2)$$

Then, the spin damping was determined by the following equation.

$$\text{Spin damping (\%)}=[(\text{Spin (rpm) during flight})/(\text{Initial spin (rpm)})\times 100\ (\%)$$

(3) Shot feel

Amateur golfers with a handicap of 10 or less hit the golf ball using a driver and evaluated. The evaluation criteria are as follows.

| Evaluation criteria | |
|---|---|
| ◎: | Ninety or more golfers replied "good". |
| ○: | Eighty or more golfers replied "good": |
| Δ: | Fifty or more golfers replied "good". |
| x: | Fifty or less golfers replied "good". |

Test Results

TABLE 17

| | Example No. | | | | | | | Comparative Example No. |
|---|---|---|---|---|---|---|---|---|
| Test item | 28 | 29 | 30 | 31 | 32 | 33 | 34 | 10 |
| Diameter of hollow portion (mm) | 10 | 10 | 10 | 18 | 10 | 18 | 10 | — |
| Formulation for core | III | IV | VI | VII | V | II | VIII | I |
| Formulation for inner cover | b | c | d | d | a | a | f | — |
| Formulation for outer cover | e | e | e | e | e | e | e | e |
| Ball initial velocity (m/second) | 65.0 | 65.1 | 65.2 | 64.8 | 64.7 | 64.3 | 65.3 | 65.2 |
| Initial spin (rpm) | 2740 | 2670 | 2589 | 2570 | 2880 | 2690 | 2670 | 2950 |
| Flight spin damping (%) | 95.2 | 96.1 | 96.8 | 97.1 | 92.6 | 95.8 | 95.3 | 90.3 |
| Carry (yard) | 230.9 | 231.3 | 232.5 | 231.5 | 228.1 | 227.5 | 230.7 | 229.5 |
| Feeling | ◎ | ◎ | ◎ | ◎ | ◎ | ◎ | ◎ | Δ |

It was recognized by the above results that the hollow golf balls having a hollow core and an inner layer cover containing high-specific gravity filler (Examples 28 to 31 and 34) showed longer flight distance by a driver in comparison with the hollow golf balls wherein the inner cover layer contained no high-specific gravity filler (Examples 32 to 33) and solid golf ball of Comparative Example 10 and showed good shot feel than the solid golf ball of Comparative Example 10.

TECHNICAL EFFECTS OF THE INVENTION

With respect to the solid golf ball of the present invention,

I. by using a hollow core having a hollow portion with a diameter of 5 to 30 mm and a hollow core outer layer portion other than the hollow portion, the reduction of the impact force, good shot feel at the time of hitting, large moment of inertia, large launch angle and increased flight distance were attained;

II. by using a hollow core having a hollow portion with a diameter of 5 to 30 mm and a hollow core outer layer portion other than the hollow portion and using a core formulation specifically formulated for the hollow core, good shot feel at the time of hitting, large moment of inertia, large launch angle and increased flight distance were attained without deteriorating rebound performance;

III. by using a hollow core having a hollow portion and a hollow core outer layer portion and making moment of inertia increased, small spin, spin retention on flight and increased flight distance can be attained;

VI. by using a hollow core having a hollow portion and a hollow core outer layer portion and limiting the cover thickness within a specific range, good rebound characteristics and improvement in durability were attained without deteriorating shot feel at the time of hitting; and V. by using a hollow core having a hollow portion and a hollow core outer layer portion and using a cover having a two-layer structure wherein the inner layer cover contains high-specific gravity filler, flight distance increased without deteriorating shot feel and rebound characteristics.

What is claimed is:

1. A hollow golf ball, comprising:

a hollow core and a cover layer formed on the hollow core, wherein the hollow core is composed of a hollow portion having a diameter of 5 to 30 mm and a core outer layer portion surrounding said hollow portion, and wherein said hollow golf ball has a moment of inertia of 82 to 86 $gcm^2$.

2. The hollow golf ball according to claim 1, wherein the core outer layer portion is made of a vulcanized molded article of a rubber composition comprising a base rubber, a metal salt of an unsaturated carboxylic acid, an organic peroxide and a filler.

3. The hollow golf ball according to claim 1, wherein the outer layer portion is made of a vulcanized molded article of a rubber composition comprising 20 to 60 parts by weight of an unsaturated carboxylic acid, 0.1 to 3.0 parts by weight of an organic peroxide, 5 to 110 parts by weight of a high-specific gravity metal filler, based on 100 parts by weight of a polybutadiene rubber having at least 90% cis-1,4-bond content.

4. The hollow golf ball according to claim 1, having a moment of inertia of 83 to 84 $gcm^2$.

5. The hollow golf ball according to claim 1, wherein the cover layer has a thickness of 2.2 to 5.0 mm.

6. The hollow golf ball according to claim 1, wherein the cover layer has a two-layer cover structure comprising an inner layer cover and an outer layer cover, and the hollow portion has a diameter of 5 to 22 mm and the core outer layer portion, surrounding said hollow portion is formed by vulcanization molding a rubber composition comprising a cis-1,4-butadiene rubber as the base resin, a metal salt of a partially or totally unsaturated carboxylic acid and an organic peroxide, and the inner cover layer contains a high-specific gravity filler and has a specific gravity of 1 to 3.

7. The hollow golf ball according to claim 1, where the cover is formed from a resin composition containing an ionomer resin.

8. The hollow golf ball according to claim 1, wherein the cover layer has a Shore D hardness of 60 to 77.

* * * * *